United States Patent [19]

Pfarre

[11] 4,274,071

[45] Jun. 16, 1981

[54] THREE-PHASE FERRORESONANT TRANSFORMER STRUCTURE EMBODIED IN ONE UNITARY TRANSFORMER CONSTRUCTION

[75] Inventor: Edgar L. Pfarre, Madison, N.J.

[73] Assignee: Bell Telephone Laboratories, Incorporated, Murray Hill, N.J.

[21] Appl. No.: 95,094

[22] Filed: Nov. 16, 1979

[51] Int. Cl.[3] ..... H01F 33/00; H01F 27/24

[52] U.S. Cl. ..... 336/12; 336/160; 336/212; 336/215

[58] Field of Search ..... 336/155, 160, 165, 212, 336/213, 214, 215, 5, 10, 12; 323/48, 49

[56] References Cited

U.S. PATENT DOCUMENTS

| | | | |
|---|---|---|---|
| 2,968,778 | 1/1961 | Steinmayer | 336/215 X |
| 3,087,108 | 4/1963 | Toffolo et al. | 336/215 |
| 3,319,205 | 5/1967 | Walz et al. | 336/165 |

*Primary Examiner*—Thomas J. Kozma

*Attorney, Agent, or Firm*—Alfred G. Steinmetz

[57] ABSTRACT

A three-phase transformer structure has a double-window magnetic structure with an independent flux path encircling each window and an outer flux path encircling both windows. A shunt path for the outer flux path bridges both windows and two additional shunt paths bridge each window independently. Hence, each flux path has an independent and isolated shunt permitting operation of the three-phase transformer in a ferroresonant mode.

8 Claims, 6 Drawing Figures

THREE-PHASE FERRORESONANT TRANSFORMER STRUCTURE EMBODIED IN ONE UNITARY TRANSFORMER CONSTRUCTION

FIELD OF THE INVENTION

This invention relates to a three-phase voltage regulator and specifically to a three-phase ferroresonant voltage regulated transformer embodied in a unitary magnetic structure.

BACKGROUND OF THE INVENTION

A conventional single-phase ferroresonant voltage regulator normally comprises a combination of a nonlinear saturating inductor, a capacitor and a linear inductor in a series-parallel circuit arrangement. These components cooperate together to respond to an AC sinusoidal input voltage and provide a voltage regulated squarewave output voltage. The inductive magnetic components of a single-phase ferroresonant voltage regulator are normally combined in a single magnetic transformer structure which further provides input-output isolation and voltage transformation. The transformer structure usually combines the linear and saturating inductor in one magnetic structure by judicious use of magnetic shunts, which provide separate magnetic paths for primary and secondary leakage flux and permit the secondary magnetic flux path to saturate without the primary magnetic flux path saturating.

Typically when a three-phase ferroresonant voltage regulator circuit is desired, three single-phase ferroresonant magnetic structures are connected in a three- phase mode to obtain the desired three-phase ferroresonant regulator circuit. Sometimes in order to reduce the size of the combined magnetic components, the three saturated reactor portions of the ferroresonant structure and the three linear magnetic portions may each be individually merged into single three-phase structures. However, arrangements of this type as proposed, for example, in U.S. Pat. Nos. 3,205,430 and 3,379,961, still require two separate independent magnetic structures. This embodiment, in two separate structures, is necessary because the independent magnetic components are needed to achieve the separate primary and secondary magnetic flux paths in a three-phase ferroresonant regulator. There are instances where it is desirable to achieve a three-phase ferroresonant regulator in a single structure, expecially in situations where a reduction in space or weight is needed.

SUMMARY OF THE INVENTION

Therefore in accordance with the principles of the invention, the magnetics of a three-phase ferroresonant voltage regulator circuit are embodied in a single unitary magnetic structure. This structure is embodied in a double window, three leg magnetic structure of tape wound construction in which each of the two windows of the structure are individually circled by an independent closed magnetic flux path. Both of these flux paths are, in turn, circled by a third closed magnetic flux path which encompasses both these windows. A unique shunting arrangement is utilized to assure that each independent closed flux path has an isolated shunt which bridges either one or both of the windows depending upon how many windows the pertinent flux path encircles. This unique scheme of providing isolated and independent shunts for each flux path permits the transformers to be operated in a natural ferroresonant mode wherein the primary and secondary flux paths are independent in each phase. Magnetic flux is generated in separate primary and secondary flux paths for each phase in response to a phase voltage in each of the three-phases.

BRIEF DESCRIPTION OF THE DRAWINGS

An understanding of the invention may be readily attained by reference to the following description and the accompanying drawings in which.

DETAILED DESCRIPTION

Figure 1:
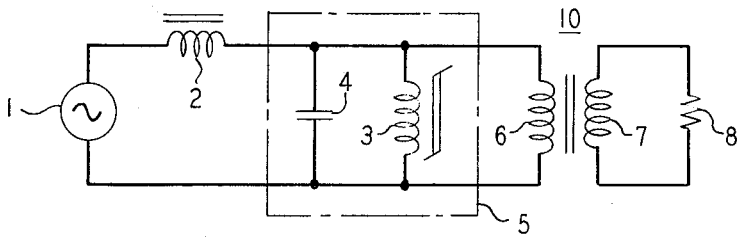
FIG. 1 (PRIOR ART)
FIG. 1 is an electrical circuit schematic of a ferroresonant voltage regulator of the prior art.

A single-phase ferroresonant voltage regulator with the magnetic components shown in idealized equipment circuit form is illustrated schematically in FIG. 1. As shown therein, a sinusoidal voltage source 1 is coupled to a linear inductor 2 which is further connected in series with a parallel combination 5 of an AC saturating nonlinear inductor 3 and a properly rated resonant capacitor 4 shunted across the nonlinear inductor 3. The voltage across the parallel resonating combination 5 is applied to a primary winding 6 of an idealized transformer 10. Its secondary winding 7 is connected to a load to be energized which is shown as a load resistor 8.

The performance characteristics of this ferroresonant voltage regulator circuit depend mainly on the magnetic characteristics of the nonlinear inductor 3, the electrical characteristics of the capacitance 4 and the magnitude of the applied voltage of sinusoidal voltage source 1. The nonlinear inductor 3, preferably, has a square loop hysteresis curve and this characteristic, in combination with the proper preselected peak magnitude of the applied sinusoidal voltage, causes it to saturate at least once each half cycle. In this mode of operation, the volt time area of the voltage across the nonlinear inductor 3 during each half cycle is equal. The resonating of the linear inductor 2 and the capacitor 4 assures that the polarity of the saturated flux reverses within each half cycle in the nonlinear inductor 3. During the interval of saturation in each half cycle, the input voltage magnitude is absorbed mainly by the linear inductor 2. Since the volts second area of each voltage curve is uniform in each half cycle, the output voltage across the nonlinear inductor 3 approximates a square waveform with a constant peak amplitude.

Figure 2:
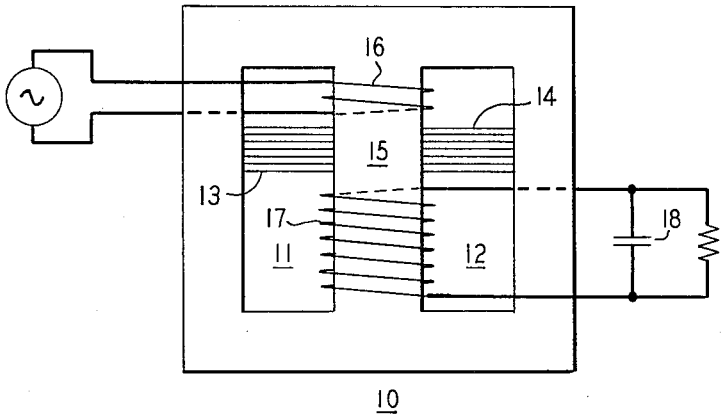
FIG. 2 (PRIOR ART)
FIG. 2 is an electrical and mechanical schematic of a typical magnetic structure configuration for the ferroresonant voltage regulator electrical circuit schematic shown in FIG. 1.

A practical physical embodiment of the ferroresonant voltage regulator illustrated as an electrical schematic in FIG. 1 is disclosed in FIG. 2. The transformer magnetic core structure 20 comprises a stacked array of E/I-type laminations. The overall transformer core structure 20 is designed having two windows 11 and 12. Two magnetic shunts 13 and 14 in windows 11 and 12 separate the primary and secondary windings 16 and 17, which are wound on a common central core 15. The linear and nonlinear inductors are, in this practical magnetic structure, embodied within the single unitary magnetic structure. The magnetic shunts 13 and 14 permit the portion of the transformer magnetic core structure, to which the primary winding 16 is directly coupled, to operate in a linear mode while permitting the transformer magnetic core structure, to which secondary winding 17 is coupled, to saturate each half cycle. The linear inductance due to flux leakage through the shunts 13 and 14 of the transformer is coupled to the primary winding 16 and limits the input current of the primary winding when the magnetic core structure coupled to the secondary winding 17 saturates. Hence, the magnetic core structure coupled to secondary winding 17 is permitted to saturate each half cycle without affecting the input impedance of the primary winding 16.

The resonating capacitor 18 coupled across secondary winding 17 resonates to reverse the saturated flux of the transformer structure coupled to secondary winding 17 to permit it to achieve its opposite polarity saturation condition in the subsequent half cycle of operation.

This particular single-phase ferroresonant structure is very practical and has been widely used in regulated rectifier applications. However, this concept has not been extended into a three-phase transformer structure because no suitable arrangement has been determined for the structure of an appropriate three-phase shunting arrangement.

Figure 3:
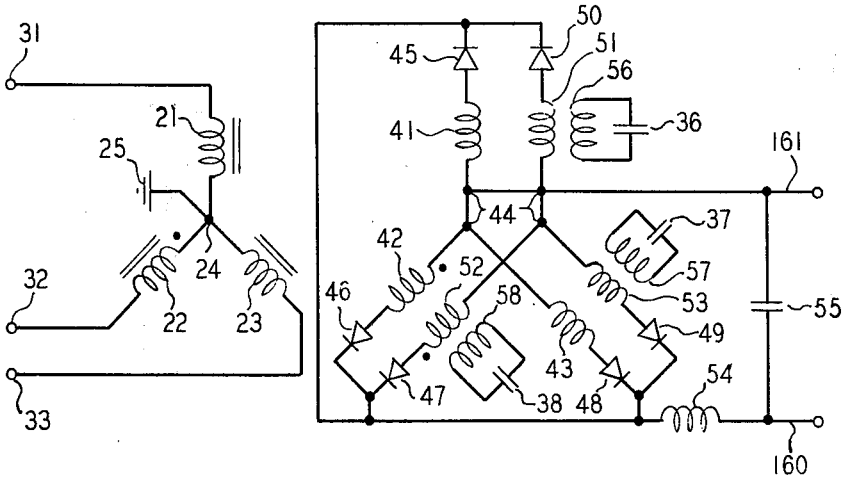
FIG. 3 is an electrical circuit schematic of a three-phase ferroresonant voltage regulator embodying the principles of the invention.

An electrical schematic of a three-phase ferroresonant voltage regulator, whose magnetic components may be embodied in a single unitary magnetic structure, is disclosed in FIG. 3. A three-phase input comprising terminals 31, 32 and 33 is coupled to a y-connected arrangement of three primary windings 21, 22 and 23. A common mode 24 of these three windings is coupled to a neutral ground return 25 to accommodate harmonics which are normally generated by nonlinearities in the voltage regulator ferroresonant magnetic structure. A three-phase secondary winding comprises two parallel y-connected winding arrangements. These windings 41, 42, 43, 51, 52 and 53 are all joined to a common mode 44 which is coupled to the output ground 160. Winding pairs 41, 51; 42, 52; and 43, 53 are each coupled to the same magnetic core. The windings of each phase are connected to rectifying diodes 45, 46, 47, 48, 49 and 50, which in turn, are all connected to an output filter including inductor 54 and capacitor 55. Additional ferroresonant windings 56, 57 and 58 are coupled to each leg of the y, and the resonating capacitors 36, 37, and 38 are coupled in parallel to these windings, respectively. It is apparent that the particular arrangement schematically shown provides a regulated DC voltage at the output terminal 160.

Figure 4:
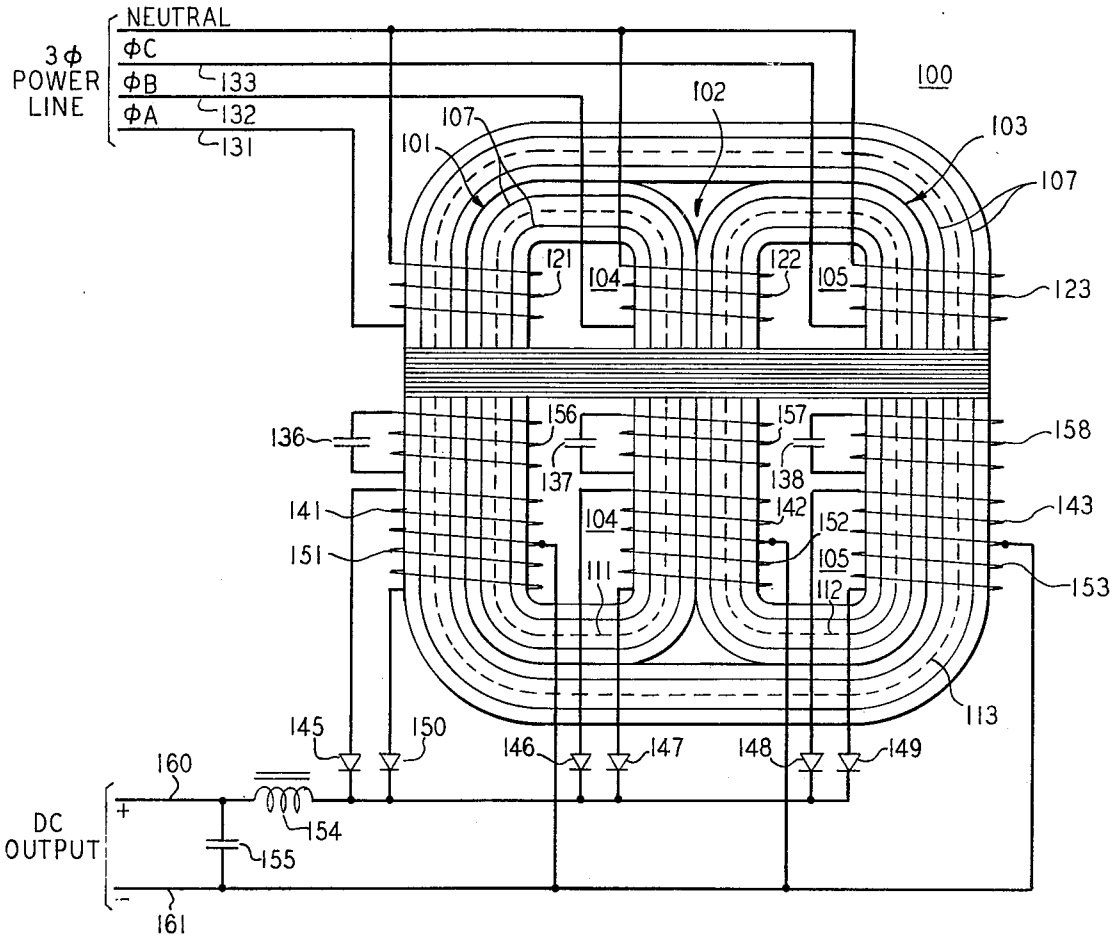
FIG. 4 is a side planar view of a practical magnetic structure embodying the principles of the invention and usable with the electrical circuit schematic of a three-phase ferroresonant voltage regulator shown in FIG. 3.
Figure 5:
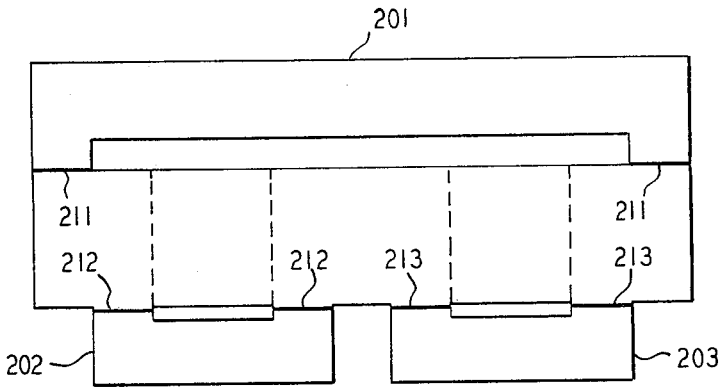
FIG. 5 is a top planar view of the magnetic structure shown in FIG. 4 showing the arrangement of magnetic shunts.

A practical magnetic structure permitting the magnetic components of this scematic arrangement shown in FIG. 3 to be embodied in one unitary magnetic structure is disclosed in FIG. 4. This magnetic structure comprises two E-shaped units abutted together to form a basic transformer core structure 100 having three legs 101, 102 and 103 and two windows 104 and 105. This three-leg magnetic structure is of tape wound construction wherein various portions of the transformer structure are individually formed of a winding of a tape made of a suitble magnetic material. A continuous magnetic tape is wound concentrically about a form. The result is a closed core formed out of a continuous tape. The core is cut apart to form two C-shaped members. This particular magnetic structure is constructed out of C-type cut cores of two different sizes. Two identical smaller C structures of tape wound construction are nested inside a large C-type structure thereby forming a composite E structure. The cut faces of two E-type sections of identical design are abutted against each other to form the closed magnetic core structure. The laminations of the magnetic tapes define magnetic paths in which magnetic flux may flow easily and yet not transfer to another portion of the structure which is an independent core wound unit. Laminar flux flow is substantially maintained through the area where the cut faces abut together. Hence, each of the windows 104 and 105 of this magnetic structure 100 are individually encircled by an independent closed magnetic flux path 111 and 112 defined by the tape laminations. Both of these flux paths and both windows 104 and 105 are also encircled by an outer closed magnetic flux path 113 defined by tape laminations which encompass both of the windows. The laminations are schematically illustrated in FIG. 4 by contour-like lines 107. Dotted lines 111, 112 and 113 indicate the orientation of the resulting three independent magnetic flux paths. The shunts bridging the windows are constructed of stacked sheet-type laminations and are described below with reference to FIGS. 5 and 6.

The primary windings 121, 122 and 123 as described above, are y-connected and an individual winding is wound on each of the three legs of the magnetic core structure. Each primary winding encompasses two of the independent magnetic flux paths 111, 112 and 113 and is separated from corresponding ferroresonant and secondary windings encompassing the same two magnetic paths by the unique shunting arrangement described hereinbelow.

On the lower portion of the core separated from the top portion by the shunting arrangement are ferroresonant windings 156, 157 and 158 in each leg, each containing a resonating capacitor 136, 137 and 138 shunted thereacross. Below these windings, on each leg, are wound the output or secondary windings 141, 151; 142, 152; and 143, 153 of the three-phase ferroresonant regulator. These windings are coupled by rectifying diodes 145, 150; 146, 147; and 148, 149 to the positive output lead 160 of the regulator. Each of these secondary winding pairs 141, 151; 142, 152; and 143, 153 are series connected and center taped. The center tape mode in each case is connected to the negative output lead 161 of the regulator output. The rectifying diodes 145, 150; 146, 147; and 148, 149 are all coupled to the output through a filter inductor 154 which operates in conjunction with a filter capacitor 155 to filter out ripple currents and provide a smooth DC output at the output terminal 160.

It is readily apparent to those skilled in the art that the above-described winding connections comprise a three- to six-phase transformer connection whereby a three-phase input is converted into a six-phase output. The six-phase output connection permits the generation of a low constant ripple DC output from a full wave rectifier connection. This connection requires fewer diodes than are necessary with a nonsplit winding three-phase output.

Each input or primary winding 121, 122 and 123 generates flux in two independent magnetic paths. The resultant flux in each path, however, is a flux whose phase and amplitude is as if each magnetic path was energized by a single winding of a three-phase input. The output winding pairs 141, 151; 142,152; and 143, 153 also embrace two independent magnetic paths. The resultant flux energizing each winding operates as if it were each energized by one phase of a three-phase flux source.

As discussed hereinabove, a unique scheme of providing isolated and independent shunts for each flux path permits this three-phase transformer to be operated in a natural ferroresonant mode. Each independent closed flux path 111, 112 and 113 is provided with an isolated shunt path which bridges either one or both of the windows. This shunt path arrangement may be readily ascertained with reference to FIG. 5, which is a top view of the magnetic structure 100 shown in FIG. 4 illustrating the structure of a suitable shunting arrangement according to the principles of the invention. The outer magnetic path 113 in FIG. 4 which encompasses both windows and is formed by the outer tape wound portion of the core structure has a shunt structure 201 which bridges both windows. Shunt structure 201 is utilized to provide a magnetic shunt path for leakage flux due to excitation of the outer magnetic path 113 in FIG. 4 due to voltage of the primary windings. This permits flux flowing in the outer magnetic path 113 to saturate in portions coupled to the secondary windings without saturating in the portions coupled to the primary windings. This shunt structure 201 may be formed of sheet-type laminations of magnetic material and is designed so that the edges of the laminations 211 abut against the edges of the tape wound construction of the outer magnetic path with no overlap to an adjacent magnetic path. This edge-type abutment permits magnetic leakage flux to flow easily between the outer flux path of the transformer core and the flux path provided by the laminated shunt 201. On the opposite side of the structure are two shunt structures 202 and 203 which independently provide shunt flux paths for each of the two inner flux paths 111 and 112 formed by the two tape wound structures which each encircle only one window 104 and 105 in FIG. 4. These shunts are likewise constructed of sheet-type laminations whose edges 212 and 213 abut against the edges of the tape wound construction of each of the inner flux path tape wound cores. Each shunt is coupled only to one magnetic path with no overlap to an adjacent magnetic path. The aforedescribed sheet-type laminated shunts may consist of stacks of steel transformer laminations or other suitable material. to assure low reluctance in the flux paths defined, the edges of the sheet laminations must abut with the edges of the tape wound construction.

Primary winding 121 denergized by phase $\phi_a$ (as-shown in FIG. 4) is wound to encompase both the outer flux magnetic path 113 and one inner magnetic flux path 111. Primary winding 122 energized by phase $\phi_b$ (as shown in FIG. 4) is wound to encompass both of the inner flux paths 111 and 112. Primary winding 123 energized by phase $\phi_c$ (as shown in FIG. 4) is wound to encircle both the outer flux path 113, and the second inner flux path 112. Since no individual flux path is coupled to more than two phases, a net resultant flux is generated in each of the individual flux paths each separated in phase from the other flux by the angle $2\pi/3$. Since each flux path has an individual shunt path for leakage flux, natural ferroresonant action is permitted in each of the individual phases of the magnetic structure. The shunt paths permit isolation between the primary winding and the corresponding secondary winding in each phase, thereby permitting the secondary portion of the magnetic structure to saturate while the primary portion remains nonsaturated. As indicated, each of the secondary windings corresponding to a primary winding is wound coupling the same magnetic paths, so that a uniform input and output scheme may be maintained.

Figure 6:
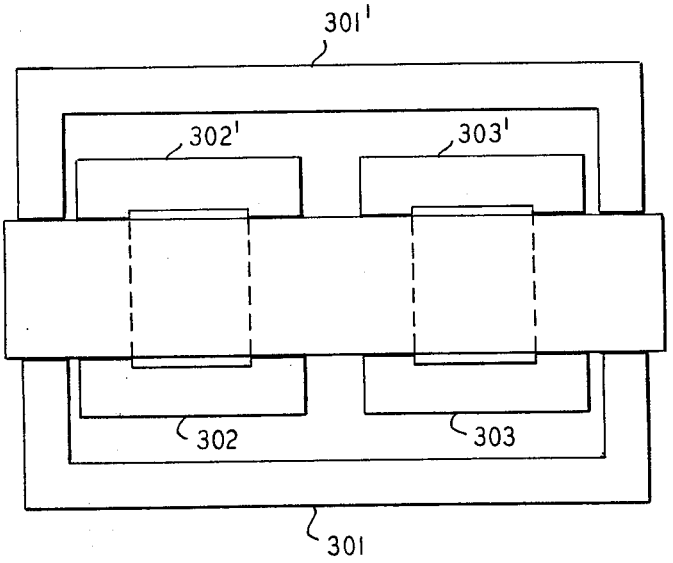
FIG. 6 is a top planar view of an alternate magnetic shunt arrangement which may be applied to the magnetic structure shown in FIG. 4.

A second alternative shunt arrangement, for application to the transformer core structure shown in FIG. 4, is illustrated in FIG. 6. This structure has a complete three-phase shunt path structure arrangement on each side of the core structure to provide a symmetrical magnetic circuit arrangement. As shown, there are individual shunts 302, 303 and 302; 303' for each of the inner flux paths located on both sides of the structure and two individual shunt paths 301 and 301' for the outer flux path also located on both sides of the structure. This symmetrical arrangement permits the use of smaller shunt path structures for leakage flux on each side of the core structure.

It is important to note that the tape wound laminated construction of the transformer core and the sheet laminated construction of the shunts with the edge abutment at the junctions of the two is essential for providing low reluctance flux paths necessary for the proper operation of this three-phase ferroresonant arrangement in a natural ferroresonant mode. As is apparent to those skilled in the art, the shunts may be constructed from C-type cut cores of tape wound construction, if desired, as long as the edge abutment requirement described above is maintained at the junction of the transformer core and the shunts.

With these principles in mind many other arrangements utilizing the principles of the invention will be readily apparent to those skilled in the art without departing from the spirit and scope of this invention.

I claim:

1. A three-phase ferroresonant transformer structure comprising;

a first and second closed flux path positioned adjacent each other and encircling a first and second window;

a third closed flux path encircling said first and second closed flux paths;

first and second magnetic shunts joining opposite portions of the first and second closed flux paths and bridging the first and second windows; respectively a third magnetic shunt joining opposite portions of the third closed flux path and bridging the first and second windows; and said first, second and third magnetic shunts each being independent and isolated from the other two magnetic shunts and magnetically coupled only to its related magnetic shunt path.

2. A three-phase ferroresonant transformer structure as defined in claim 1 wherein;

said first and second directed flux paths are constructed of tape wound magnetic cores each comprising;

two abutting cut C-type structures of concentrically wound tape of magnetic material and positioned adjacent within the third closed flux path;

said third closed flux path also comprising a tape wound magnetic core constructed of two abutting cut C-type structures of concentrically wound tape of magnetic material so that the first and second flux paths are nested within a clear open area encircled by the third flux path;

whereby the third flux path encircles the first and second flux paths including the first and second windows.

3. A three-phase ferroresonant transformer structure as defined in claim 2 wherein;

said first and second magnetic shunts comprise;

a first and second construction of sheet laminations of magnetic material each arranged to have their edges abutted against the edges of the wound magnetic tape core of the first and second flux paths, respectively and abutting contact thereto constricted to connect only to their respective first and second magnetic flux paths; and said third magnetic shunt comprising a third construction of sheet laminations and having the edges thereof abutting against edges of the wound magnetic tape of the third magnetic flux path only.

4. A three-phase transformer as defined in claim 3 wherein;

each of the first, second and third magnetic shunts having a similar and oppositely positioned magnetic shunt structure of likewise construction coupled to the opposite side of the magnetic transformer core and bridging the same identical window arrangement.

5. A three-phase ferroresonant transformer structure comprising;

a main transformer structure including two identical E-type structures each constructed of three C-shape cut tape wound cores as component parts, two smaller C-shape cores being nested within a larger C-shape core and the two E-type structures abutted together to form a three leg magnetic transformer structure having two windows and first, second and third well defined magnetic flux path structures, the first and second flux path structures each encircling a different one of the two windows, and the third flux path structure encircling both the two windows; first, second and third magnetic shunts each constructed of sheet lamination;

said first, second, and third magnetic shunts each bridging windows encircled by said first, second, and third magnetic flux paths, respectively; and edges of the sheet laminations of the first, second and third magnetic shunts abutting tape edges of a related one of the first, second, and third magnetic flux path structure.

6. A three-phase ferroresonant transformer structure as defined in claim 5 wherein;

input windings are y-connected and a winding in each phase is coupled to two magnetic paths and output windings are y-connected and a winding in each phase is split and couples two magnetic paths to form a six-phase output arrangement.

7. A three-phase ferroresonant transformer structure as defined in claim 1, wherein said first, second and third flux paths are constructed of a main transformer structure including two identical E-type structures each constructed of three C-shape cut tape wound cores as component parts, two smaller C-shape cores being nested within a larger C-shape core to form E-type structures and two E-type structures abutted together to form a three leg magnetic transformer structure enclosing said first and second windows and including the said first, second and third flux paths, the first and second flux paths each encircling a different one of the first and second windows and the third flux path encircling both the first and second windows.

the first, second and third magnetic shunts each comprised of sheet laminations, and edges of the sheet laminations of the first, second and third magnetic shunts abutting tape edges of a related one of the first, second and third magnetic flux path structures.

8. A three-phase ferroresonant transformer structure as defined in claim 7 wherein;

input windings are y-connected and a winding in each phase is coupled to two magnetic paths and output windings are y-connected and a winding in each phase is split and couples two magnetic paths to form a six-phase output arrangement.

* * * * *

UNITED STATES PATENT AND TRADEMARK OFFICE

CERTIFICATE OF CORRECTION

PATENT NO. : 4,274,071

DATED : June 16, 1981

INVENTOR(S) : Edgar L. Pfarre

It is certified that error appears in the above—identified patent and that said Letters Patent is hereby corrected as shown below:

Column 3, line 62 "scematic" should read --schematic--.

Column 4, line 3 "suitble" should read --suitable--.

Column 5, line 58 "denergized" should read --energized--.

Signed and Sealed this

*Thirteenth* Day of *October 1981*

[SEAL]

*Attest:*

GERALD J. MOSSINGHOFF

*Attesting Officer*

*Commissioner of Patents and Trademarks*